United States Patent [19]

Leung et al.

[11] Patent Number: 4,585,051

[45] Date of Patent: Apr. 29, 1986

[54] HEAT EXCHANGE BETWEEN SOLIDS

[75] Inventors: Leung S. Leung, Graceville; Yat O. Chong, St. Lucia, both of Australia

[73] Assignee: University of Queensland, Australia

[21] Appl. No.: 692,891

[22] PCT Filed: Dec. 6, 1983

[86] PCT No.: PCT/AU83/00180

§ 371 Date: Jan. 8, 1985

§ 102(e) Date: Jan. 8, 1985

[87] PCT Pub. No.: WO84/04584

PCT Pub. Date: Nov. 22, 1984

[30] Foreign Application Priority Data

May 13, 1983 [AU] Australia ..... PF9339

[51] Int. Cl.[4] ..... F28D 13/00

[52] U.S. Cl. ..... 165/1; 165/104.16; 165/111; 165/920; 34/57 A

[58] Field of Search ..... 165/104.16, DIG. 27, 165/111, 1; 34/57 A; 422/146

[56] References Cited

U.S. PATENT DOCUMENTS 2,581,041 1/1952 Ogorzaly et al. .

3,075,580 1/1963 Davis, Jr. ..... 422/146

3,299,947 1/1967 Boucraut et al. .

3,617,038 11/1971 Schmidt et al. ..... 34/57 A 4,021,927 5/1977 Idaszak ..... 34/57 A

FOREIGN PATENT DOCUMENTS

49628/79 2/1980 Australia .

59880/80 6/1984 Australia .

435347 10/1967 Switzerland .

278704 4/1929 United Kingdom .

*Primary Examiner*—Albert W. Davis, Jr.

*Attorney, Agent, or Firm*—Schwartz, Jeffery, Schwaab, Mack, Blumenthal & Evans

[57] ABSTRACT

A method of the exchange of heat between solids where the heated solids are passed through heat conducting tubes defining a first flow path or zone in the heat exchanger and the solids to be heated are passed through the interstitial space around the tubes, or through secondary tubes, in the heat exchanger, defining a second flow path or zone. The solids are physically separated by the walls of the tubes which act as a heat conducting barrier and the solids are flowed, under moving-bed conditions, in counter-current or concurrent directions to enable the heat transfer to be effected.

11 Claims, 14 Drawing Figures

HEAT EXCHANGE BETWEEN SOLIDS

BACKGROUND OF THE INVENTION (1) Field of the Invention

This invention relates to a method of, and apparatus for, the exchange of heat between solids.

(2) Brief Description of the Prior Art

In many chemical processes, it is necessary to conserve the heat applied to (or generated by) the process to enable the processes to be effected efficiently and economically. To conserve the heat, it must be exchanged between the reacted products and the reactive components of the processes.

The most general method of exchanging the heat between solids is to mix the solids to enable the exchange to occur. This method has two major disadvantages. Firstly, when the exchange has occurred, the solids must be physically separated. Secondly, the temperature of the mixture is always less than the temperature of the hotter of the two solids. For example, if equal quantities of reacted product at 500° C. are mixed with reactive components at 100° C., the temperature of the mixture will be approximately 300° C. (i.e. the mean of the two temperatures).

SUMMARY OF THE INVENTION

It is an object of the present invention to provide a method where the solids are not mixed and so are physically separated as the heat exchange is effected.

It is a preferred object to provide a method in which heat exchange takes place between two solid streams in continuous flow.

It is a further preferred object to provide a method where the solids, which are to be heated, reach a temperature higher than the exit temperature of the solids from which the heat is removed.

It is a still further preferred object to provide a method which enables the reactive components to flow through the heat exchanger to receive the heat from the reacted products, pass through a reactor and then be returned to the heat exchanger to heat the incoming reactive components in a substantially continuous flow.

It is a still further preferred object to provide an apparatus for the method which is designed to control the flow of the solids through the heat exchanger to ensure maximum transfer of heat between the solids.

Other preferred objects of the present invention will become apparent from the following description.

In one aspect the present invention resides in a method of exchanging heat between solids including the steps of:

(a) passing the heated solids through a heat exchanger in a substantially continuous flow in a first flow path;

(b) passing the solids to be heated through the heat exchanger, physically separated from the heated solids, in a substantially continuous flow, in a second flow path countercurrent or concurrent to the first flow path; and (c) transferring the heat from the heated solids to the solids to be heated through a heat conductive barrier separating the solids.

In a second aspect the present invention resides in an apparatus for the exchange of heat between solids including:

a heat exchanger divided into a first zone and a second zone defining respective first and second flow paths, separated by a heat conducting barrier;

an inlet and outlet for the first zone to enable heated solid to pass through the zone; and an inlet and outlet for the second zone to enable solid to be heated to pass through the zone, so arranged that:

as the solids flow in countercurrent or concurrent direction through the zones, heat is transferred to the solids in the second zone.

The heat exchanger may include an exchange chamber having a plurality of tubes which form one of the two zones (the tube side of the exchanger), the other (or second) zone being formed by the interstitial space in the chamber surrounding the tubes or by secondary tubes (the shell side of the exchanger).

The inlet to the first zone may be connected to a supply chamber of the heated solids in a fluidized or non-fluidized state and the outlet of the first zone connected to a collection chamber for those solids.

The inlet of the second zone may be connected to a solids feeding device and the outlet of the second zone may be connected to an overflow opening or a solids withdrawal device.

The flowing solids in both zones may be fluidized or in moving-bed flow.

Preferably, inserts are provided in the second zone (shell side) to maintain a substantially constant gas velocity in the second zone to compensate for expansion of gas in the vertical direction due to pressure and temperature changes. Preferably, baffles will be provided to break up bubbles in the gas fluidizing the solids to prevent mixing or circulation of the solids in the vertical direction. The gas flow rate in the shell side can be adjusted by bleeding gas from the exchange via a number of control valves to control the relative velocity between gas and solid to a certain upper limit. This control is sometimes necessary to prevent the formation of bubbles which may cause undesirable mixing of solids.

BRIEF DESCRIPTION OF THE DRAWINGS

To enable the invention to be fully understood, a number of preferred embodiments will now be described with reference to the accompanying drawings, in which.

DETAILED DESCRIPTION OF THE PREFERRED EMBODIMENT

Figures 1, 2, 3:
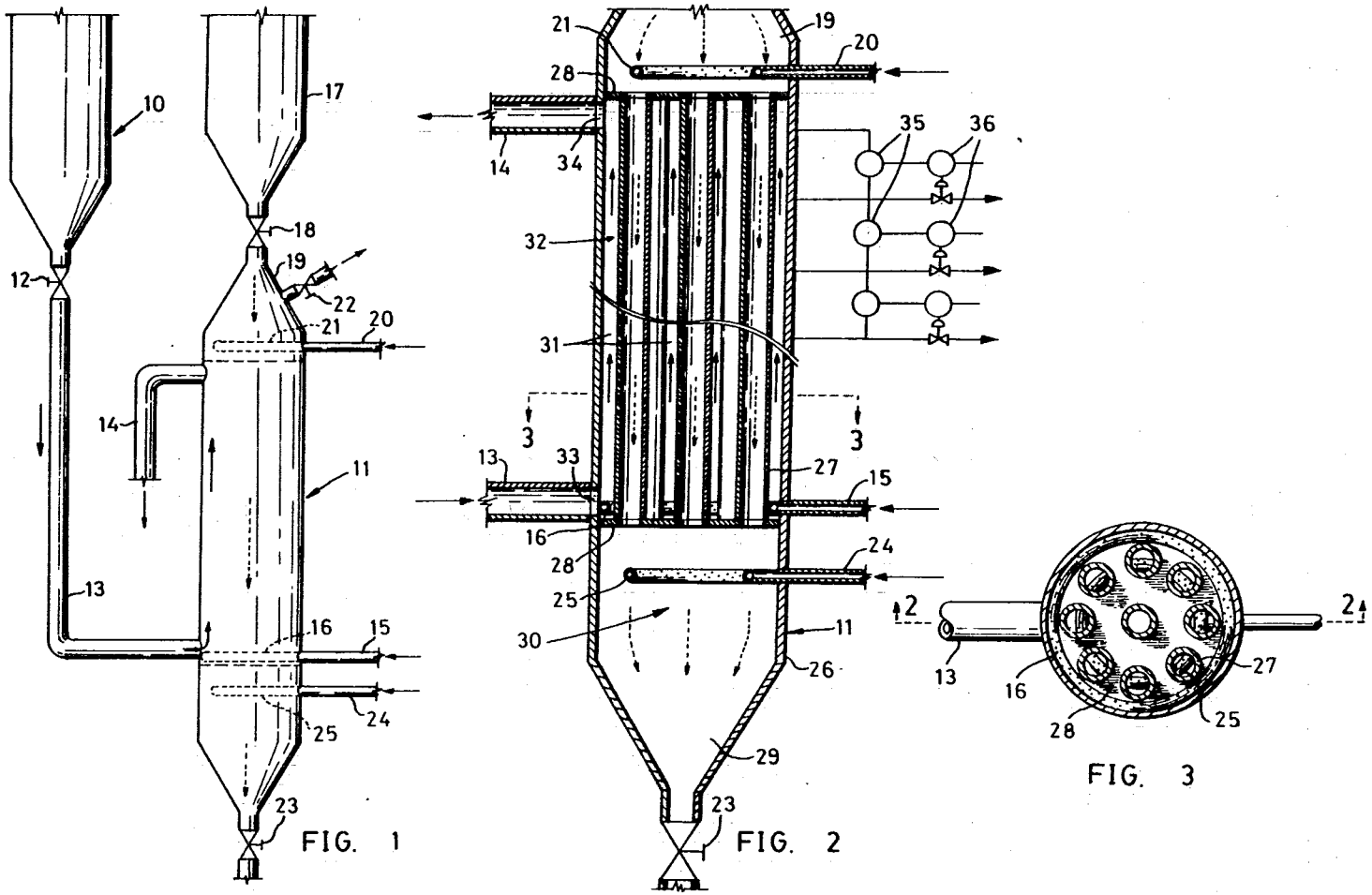
FIG. 1 is a schematic layout of the heat exchanger.
FIG. 2 is a schematic sectional side view of a first embodiment of the heat exchanger.
FIG. 3 is a sectional plan view taken on line 3—3 on FIG. 2.

Solids (in fine particulate or granular form) to be heated, and gas are fed at controlled rates from a supply hopper 10 to the heat exchanger 11 via a suitable control valve 12 and supply line 13. The solids and gas, when heated, leave the heat exchanger via an exit line 14.

To control the flowability of the solids, an independent stream of gas may be introduced from line 15 to the lower section of the shell side of the exchanger via a gas distributor 16.

The other (heated) stream of solids is supplied to the exchanger from a feed hopper 17 via a control valve 18 to the feed chamber 19. The solids in 19 may be fluidized by introducing gas into the chamber from gas line 20 via gas distributor 21 and is released through valve 22. The solids then flow through the tubes of the heat exchanger and are discharged via the control valve 23. Additional gas may be introduced through a gas line 24 and distributor 25 to control the solids flow pattern in the tubes, but this is not essential. The gas flow inside the tubes may be in either upward or downward direction. (The flows of the two separate solids stream are indicated by solid arrows and dashed arrows, respectively, in FIG. 1).

Referring now to the first embodiment of FIGS. 2 and 3, the heat exchanger 11 has an exchange chamber 26 generally divided into two exchange zones. Tubes 27 are provided at spaced intervals in the chamber 26 and are supported at their ends by plates 28 which receive the ends of the tubes to enable communication of the tubes with an inlet zone 19 and outlet zone 29. Solids in inlet zone 19 may be fluidized from gas in line 20 via distributor 21. The tubes 27, inlet zone 19 and outlet zone 29 define the first exchange zone 30.

The interstitial spaces 31 around the tubes 27, closed by the end plates 28, define the second exchange zone 32, which has an inlet 33 and an outlet 34 connected to supply lines 13 and 14 respectively. Gas can be supplied to this zone at the bottom from line 15 via gas distributor 16.

In operation the heated solids, which may be fluidized, enter the inlet zone 19 and flow down the tubes 27. At the top of the tubes, the heated solids may have a temperature of e.g. 700° C.

Simultaneously, the flow of the solid to be heated (and gas) enters the second zone 32, via inlet 33 at the bottom of that zone, at a temperature of e.g. 30° C., and moves up the zone.

As the solids flow in countercurrent direction in the respective first and second zones 30, 32, the heat from the heated solids in the first zone 30 is conducted through the walls of the tubes 27 to the solids in the second zone 32. At the top of the second zone, the now heated solids pass out the exit 34 with a temperature that may approach 700° C., while the now cooled solids in the first zone 30 enter the outlet zone 29 at a temperature that may approach 30° C. Therefore efficient exchange of heat between the zones has occurred.

As the solids and gas move up the second zone 32 (in the shell side of the exchanger), the heated gas may expand to changes in temperature and pressure. If this expansion is not compensated for, the gas flow may become disturbed and break up the continuity of flow of the solids in the second zone. A number of methods to compensate for the gas expansion are embodied in the various preferred embodiments of this invention.

In the first embodiment of the invention shown in FIGS. 2 and 3, a constant gas velocity is maintained in the second zone 32 by drawing off some of the now-heated gas from the second zone at various vertical locations. Pressure sensors 35 monitor the pressure differentials across two levels in the second zone. If the pressure differentials exceed preset levels, the sensors 35 actuate control valves 36 to bleed off gas from the second zone and so control the vertical gas velocity in the zone. The gas velocity is controlled to maintain the mode of solids flow to the moving-bed mode or to fluidized flow near the state of independent fluidization. In this manner, axial solids mixing in the second zone is minimized.

Figure 5:
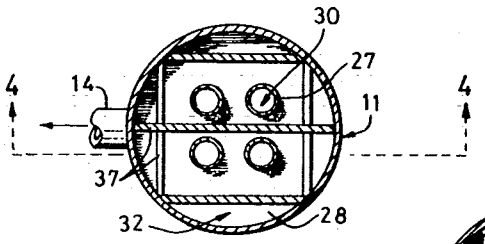
FIGS. 5 and 6 are sectional plan views taken on line 5—5 and 6—6, respectively, on FIG. 4.
Figure 6:
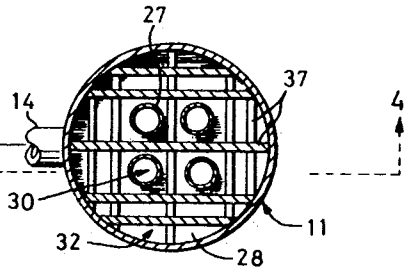
Figure 4:
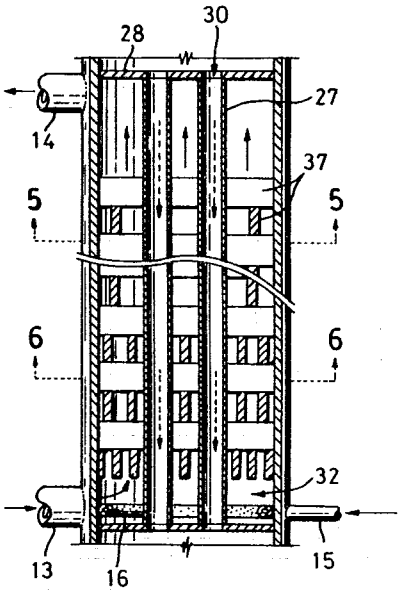
FIG. 4 is a schematic sectional side view of a second embodiment of the heat exchanger.

In the second embodiment shown in FIGS. 4 to 6, the constant gas flow in the second zone is maintained by the use of inserts 37. The inserts vary the effective cross-sectional area available to flow in the second zone 32 to counteract the effect of gas expansion. As shown in FIGS. 5 and 6, more baffles 37 are provided in the lower section of the second zone than in the upper section. Therefore the free cross-section available for gas flow is larger in the upper section of the second zone, compensating for the effect of the gas expansion.

Figure 7:
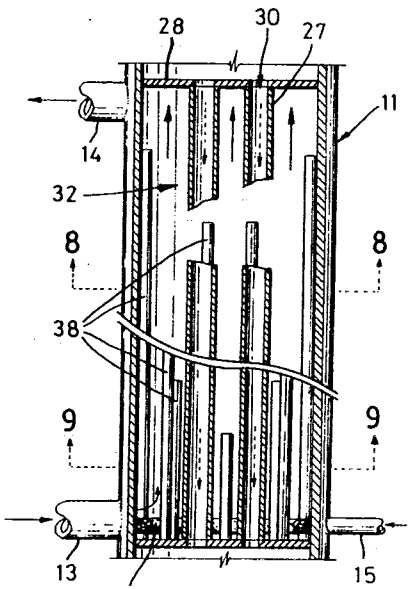
FIG. 7 is a schematic sectional side view of a third embodiment of the heat exchanger.
Figure 8:
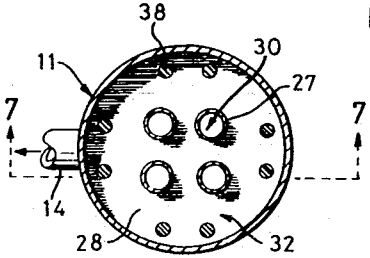
FIGS. 8 and 9 are sectional plan views taken on line 8—8 and 9—9, respectively on FIG. 7.
Figure 9:
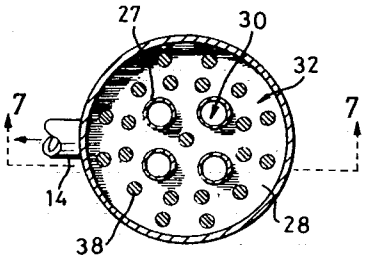

In the third embodiment of FIGS. 7 to 9, the horizontal baffles 37 are replaced by vertical baffles or rods 38 of different lengths, again allowing a larger free cross-sectional area for vertical flow in the upper section of the second zone 32 than in the lower section.

Figure 11:
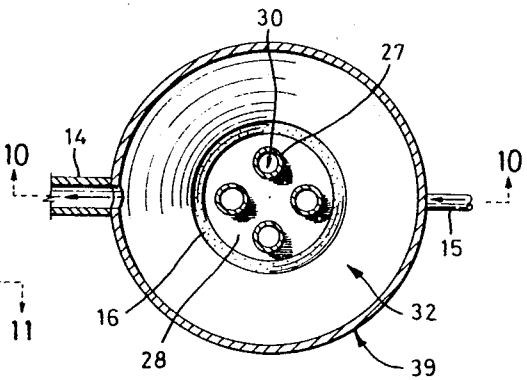
FIG. 11 is a sectional plan view taken on line 11—11 on FIG. 10.
Figure 10:
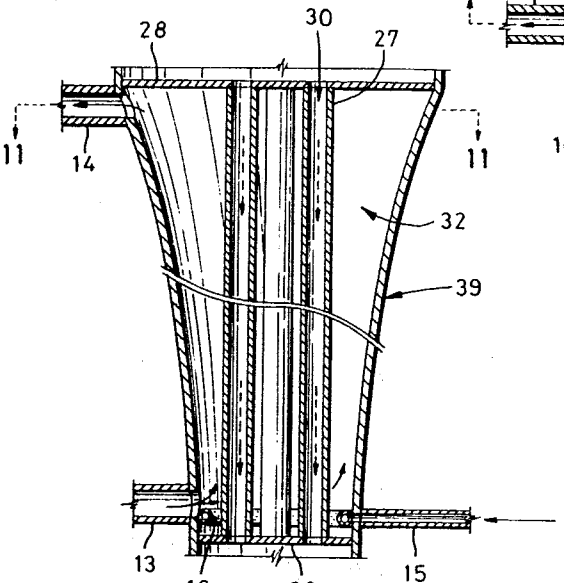
FIG. 10 is a schematic sectional side view of a fourth embodiment of the heat exchanger.

In the fourth embodiment of FIGS. 10 and 11, inserts or baffles are dispensed with in the second zone 32 and a divergent shell 39 is employed. The upward divergence of the shell 39 is designed to compensate for the expansion of the gas due to the change of temperature and pressure. This embodiment is the least flexible as unlike the embodiments hereinbefore described, it cannot be readily modified or changed to suit different operating conditions.

Figure 12:
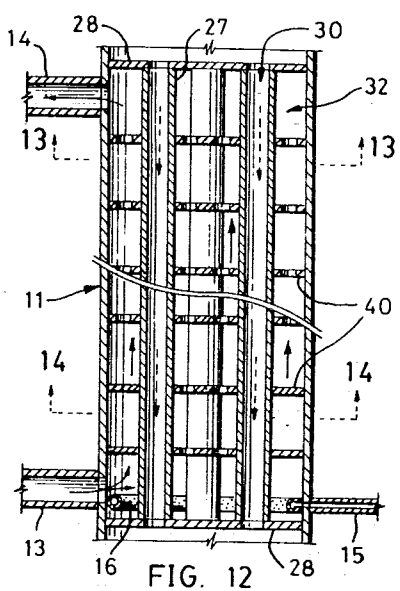
FIG. 12 is a schematic sectional side view of a fifth embodiment of the heat exchanger.
Figure 13:
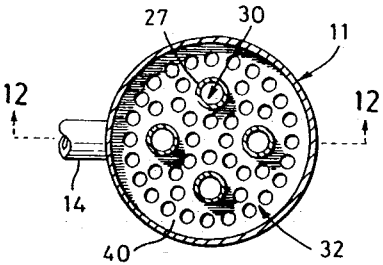
FIGS. 13 and 14 are sectional plan views taken on lines 13—13 and 14—14, respectively, on FIG. 12.
Figure 14:
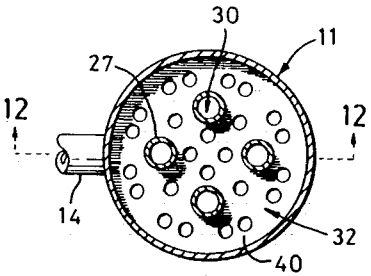

In the fifth embodiment shown in FIGS. 12 to 14, axial mixing of the solids in the second zone 32 is reduced by the partitioning of the zone in a plurality of sections by a series of perforated plates 40. By suitable design of the diameter, number and positioning of the openings 41 in successive perforated plates 40 up the second zone, axial solid mixing can be minimized.

Arrangements other than those described in FIGS. 2–14 may also be used to minimise axial solid mixing and to promote smooth vertical flow of the solids/gas mixture in the second zone 32 of the exchanger.

The embodiments hereinbefore described refer to counter-current flow in the two zones 30, 32. Concurrent flow of the two solid streams can also be operated by reversing the direction of flow of one of the solids streams.

It will be readily apparent to the skilled addressee that the solids to be heated may be passed through the tubes and the heated solids through the interstitial spaces, or that the interstitial spaces may be replaced by secondary tubes. It will also be apparent that the tubes will be arranged to give the greatest cross-sectional area for heat exchange and that the heat exchanger will be constructed from heat conductive, but inert, components. Various methods of enhancing heat transfer by use of fins or internal inserts in the tubes, and other means, may be incorporated in the exchanger.

The particle or granule size of the solids will be selected to satisfy the requirements of smooth solids flow through the heat exchanger, under, preferably, moving bed or fluidized flow conditions.

The application of the heat exchanger is not restricted to the reactive or reactor systems described above, but includes other systems where heat exchange between two solids streams in a counter-current manner is desirable.

Various changes and modifications may be made to the embodiments described and illustrated without departing from the scope of the present invention hereinafter defined in the appended claims.

I claim:

1. A method for exchanging heat between gas-solids mixtures, comprising the steps of:

(a) passing a first heated gas-solids mixture from which heat is to be extracted through a heat exchanger in a substantially continuous flow in a first flow path;

(b) passing a second gas-solids mixture to be heated by said first mixture through said heat exchanger in a substantially continuous flow in a second flow path physically separated from but in heat exchange relation with said first flow path, and (c) maintaining a constant gas velocity in said second flow path to compensate for expansion of the heated gas in said second gas-solids mixture and to prevent mixing or circulation of the solids in said second mixture, and (d) maintaining said second mixture in a moving-bed mode approaching but not exceeding a state of incipient or minimal fluidization, thereby enhancing the heat exchange between said first and second mixtures.

2. A method as claimed in claim 1 wherein the heated solids of said first mixture are passed through spaced heat conductive tubes in the heat exchanger, which define the first flow path, and wherein the solids of said second mixture to be heated are passed through the interstitial spaces around the tubes, said interstitial spaces defining the second-flow path.

3. A method as claimed in claim 1, further including the step of directing the second flow path through inserts or baffles to maintain a substantially constant gas velocity in the second flow path to compensate for expansion of the gas due to temperature and pressure changes in the flow path, and to limit axial mixing or circulation of the solids in the second flow path.

4. A method as claimed in claim 1, further including the step of bleeding gas from the second flow path to maintain a substantially constant gas velocity in the second flow path to compensate for expansion of the gas due to temperature and pressure changes in the second flow path, and to limit axial mixing or circulation of the solids in the second flow path.

5. Apparatus for the exchange of heat between a first heated gas-solids mixture and a second gas-solids mixture to be heated, comprising:

(a) a heat exchanger having first and second heat exchange zones for receiving said first and second mixtures, respectively, said zones being physically separated by heat conducting barriers;

(b) said first exchange zone comprising an inlet to receive said first mixture, a plurality of heat exchange tubes communicating with said inlet and through which said first mixture passes, and an outlet through which said first mixture passes following heat exchange;

(c) said second exchange zone comprising an inlet for delivering said second mixture to said heat exchanger, means defining an area through which said second mixture can be passed in heat exchange with said first mixture, and an outlet for said second mixture after passing through said heat exchanger and being heated by said first mixture, and (d) means for maintaining in said second exchange zone a constant gas velocity to compenstate for expansion of the heated gas in said second mixture and to prevent mixing or circulation of the solids in said second mixture, and (e) means for maintaining said second mixture in a moving-bed mode approaching but not exceeding a state of incipient or minimal fluidization, thereby enhancing the heat exchange between said first and second mixtures.

6. The apparatus of claim 5 wherein said second exchange zone is formed by the interstitial space around said tubes in said heat exchanger.

7. The apparatus of claim 5 wherein said means for maintaining said second mixture at a constant gas velocity comprises baffle means provided in said second zone, said baffle means being so constructed and arranged as to progressively increase the effective cross-sectional area of said second exchange zone as said second gas-solids mixture flows toward the outlet of said zone, thereby compensating for gas expansion.

8. The apparatus of claim 7 wherein said baffle means comprises baffle inserts positioned horizontally and vertically in said second exchange zone.

9. The apparatus of claim 7 wherein said baffle means comprises spaced rods vertically positioned in said second exchange zone and of varying height from the inlet of said zone, thereby providing for increased gas expansiion in the region of said second exchange zone approaching the outlet thereof.

10. The apparatus of claim 5 wherein said means for maintaining said second mixture at a constant gas velocity comprises pressure sensors positioned at various vertical levels in the second zone to monitor the pressure at such levels, and control valves being actuatable by said pressure sensors to bleed gas from the second zone when the pressure exceeds preset levels, so as to maintain a substantially constant gas velocity in the second zone.

11. The apparatus of claim 5 wherein the wall of the heat exchanger is outwardly divergent in the vertical direction to progressively upwardly increase the effective cross-sectional area of the second zone to maintain a substantially constant gas velocity in the vertical direction in the second zone.

* * * * *